United States Patent [19]

Johnson, III et al.

[11] 4,305,831

[45] Dec. 15, 1981

[54] LUBRICANT COMPOSITIONS

[75] Inventors: Andrew L. Johnson, III, Overland Park; Ray D. Lawson, Shawnee; Jon C. Root, Leawood, all of Kans.

[73] Assignee: Southwest Petro-Chem, Inc., Olathe, Kans.

[21] Appl. No.: 186,164

[22] Filed: Sep. 11, 1980

[51] Int. Cl.[3] ..... C10M 5/22; C10M 7/36; C10M 5/28

[52] U.S. Cl. ..... 252/18; 252/22; 252/25

[58] Field of Search ..... 252/16, 25, 45

[56] References Cited

U.S. PATENT DOCUMENTS

| | | | |
|---|---|---|---|
| 3,843,528 | 10/1974 | Bailey et al. | 252/18 |
| 4,107,058 | 8/1978 | Clarke et al. | 252/45 |
| 4,131,552 | 12/1978 | Marcantonio | 252/45 |

OTHER PUBLICATIONS

Condensed Chemical Dictionary, 9th Edition, 1977, p. 686.

*Primary Examiner*—Delbert E. Gantz
*Assistant Examiner*—Helane Maull
*Attorney, Agent, or Firm*—Wallenstein, Wagner, Hattis, Strampel & Aubel

[57] ABSTRACT

Lubricant compositions adapted for use under extreme pressure conditions comprising a major proportion of a lubricating grease, and a minor proportion of an additive consisting essentially of a solid, oil insoluble arylene sulfide polymer, and a metal salt, particularly an alkali metal or alkaline earth metal salt, particularly an alkali metal or alkaline earth metal salt of a phosphorus acid, for example, mono- or dicalcium phosphate, or an alkali metal or alkaline earth metal carbonate exemplified by calcium carbonate, or a mixture of such a phosphate salt and carbonate.

14 Claims, No Drawings

LUBRICANT COMPOSITIONS

The present invention relates to improved lubricant compositions adapted for use under extreme pressure conditions.

The development of a satisfactory grease composition for use under high pressure, high temperature and high speed conditions has received widespread attention over the years. As a result, numerous additive materials and combinations thereof, have been proposed, many of which are the subject matter of patents. Additive materials which have been proposed for the preparation of such grease compositions include lead-sulfur systems, heavy metal sulfide systems, particularly molybdenum disulfide systems, soluble phosphorus-sulfur systems, and, more recently, oil insoluble phosphorus-oil soluble sulfur systems as disclosed in U.S. Pat. No. 4,107,058. These materials, while providing some effectiveness under extreme pressure conditions, have certain shortcomings, both economic and functional. Thus, for example, molybdenum disulfide which, perhaps, has received the most general acceptance as an additive for the preparation of extreme pressure lubricants, is relatively expensive and represents an unsatisfactory cost factor to manufacturers of such greases. Also, with systems such as those mentioned above, there is the possibility for breakdown under severe and/or prolonged conditions of use, resulting in the release of sulfur. The sulfur, which may be in a free or combined state, can, in time, cause serious corrosion to metal parts in contact with the grease compositions.

In accordance with the present invention, improved extreme pressure lubricant compositions have been evolved which have important cost advantages over extreme pressure greases utilizing molybdenum disulfide as an additive, and which, furthermore, remain stable even after prolonged use at the high pressures and elevated temperatures encountered in extreme pressure applications. The compositions, in addition, are characterized by having load-carrying capacities which are superior to the more conventional extreme pressure greases, especially those incorporating molybdenum disulfide.

In brief, the lubricant compositions of this invention comprise a major proportion of a lubricating grease and a minor proportion of an additive consisting essentially of a solid, oil insoluble arylene sulfide polymer and a metal salt, preferably an alkali metal or alkaline earth metal salt selected from the group consisting of alkali metal or alkaline earth metal phosphates and alkali metal or alkaline earth metal carbonates, and mixtures of such metal phosphates and carbonates.

The arylene sulfide polymers useful for the purposes of the present invention are characterized by their high melting point, their insolubility not only in oil, but, also, in all common solvents at a temperature below about 400° F., their resistance to chemical attack by acids and a wide variety of other reagents including oxidizing agents, and their non-flammability. The polymers advantageously are employed in a pulverulent, or powder-like, form, having an average particle size in the range of 50 to 150 mesh, usually about 60 to 80 mesh, more or less. The polymers, if desired, can be subjected to further grinding to reduce the average size of the particles to micron size in the range, for example, of about 1 micron to upwards of 100 microns. Further reduction in size, however, is not essential to the attainment of the objectives of the invention. An especially preferred arylene sulfide polymer is a polyphenylene sulfide sold under the trade designation "RYTON" (Phillips Petroleum Company). The polymer may be represented by the formula $(-C_6H_4S-)_x$ wherein x is an integer from about 10 to about 50, or more.

Generally speaking, any of the alkali metal or alkaline earth metal phosphates and carbonates may be used in formulating the lubricant compositions. More specifically, the alkali metal phosphate or carbonate may be lithium, sodium or potassium phosphate or carbonate. The alkaline earth metal phsophate or carbonate can be a calcium, strontium, barium or magnesium phosphate or carbonate. Other metal salts which can be used include aluminum phosphate, ferric orthorphosphate, cadmium carbonate, cadmium phosphate, and the like. The preferred metal salts are monocalcium phosphate and dicalcium phosphate, and calcium carbonate, and mixtures thereof. The metal salts, like the arylene sulfide polymers, advantageously are used in a pulverulent, or powder-like, form. The particle size of the metal salts employed desirably should be in the range of from about 1 micron to about 30 to 40 microns, more or less.

The lubricant greases useful in the preparation of the lubricant compositions of this invention can be any of the known greases employed as bases for extreme pressure applications. Illustrative examples of such greases are the metal soap-thickened mineral oil base greases such as lithium stearate and lithium hydroxy stearate greases, sodium stearate greases, aluminum hydroxybenzoate-stearate greases, and the like. Also useful are metal soap-thickened synthetic hydrocarbon oils and synthetic ester oils exemplified by alkyl benzenes, silicone oils, and esters of dibasic acids. In addition, clay based greases such as bentonites and attapulgite greases can be used, as can silica gel greases and barium greases.

While the proportions of the polymer and the metal salt, or mixture of metal salts, comprising the additive used in formulating the lubricant compositions is somewhat variable, the generally optimum objectives of the invention are attained with ratios of polymer to metal salt in the range of about 1:9 to about 9:1, with a ratio of polymer to metal salt of the order of about 1:1 being preferred. In those instances where a combination of metal salts, for example, an alkaline earth metal phosphate such as dicalcium phosphate and an alkaline earth metal carbonate exemplified by calcium carbonate is used in conjunction with the polymer, the ratio of phosphate to carbonate employed advantageously is in the range specified in co-pending U.S. patent application Ser. No. 131,526 filed Mar. 18, 1980, entitled "Lubricant Compositions,"that is, about 1:1 to about 1.25:1.

The proportions or concentrations of the additive package, that is, the polymer and the metal salt, or mixture of metal salts, incorporated into a grease base will, generally speaking, be in the range of about 1% to about 15%, by weight, of the resulting composition, with a range of about 2% or 3% to about 7%, especially about 5%, by weight, providing optimum results. The polymer and the metal salt, or salts, comprising the additive may be added to the grease base separately or as a pre-mixed additive package. Conventional equipment and techniques can be employed to achieve even dispersion or distribution of the additive in the final compositions.

In accordance with another aspect of the invention, the components of the additive package may be supplemented, or replaced, in part, by other additives especially graphite. In such cases the amount of the supplementary or replacement additive used may range from about 0.5% to 2.5%, usually about 1% to about 1.5%, by weight, of the composition.

In order to impart coloring haracteristics to the lubricant compositions which are comparable to those of conventional extreme pressure greases such as those comprising molybdenum disulfide, a pigment, or a mixture of pigments, desirably is incorporated into the compositions. Specific examples of pigments preferred for this purpose are ferric oxide, titanium dioxide, and carbon black, and mixtures thereof. The proportion of pigments used can range from about 0.5% to about 10%, usually about 1% to about 5%, by weight, of the total weight of the additive package.

By way of illustration, and to demonstrate the effectiveness under extreme pressure conditions of the lubricant compositions of this invention, a number of grease based compositions were prepared utilizing an additive package as described above. The grease bases employed included:

Base #1: No. 2 grade lithium hydroxystearate grease composed of both naphthenic and paraffinic oils with a viscosity of 75 SUS at 210° F. and 850 SUS at 100° F. and a viscosity index of 50.

Base #2: No. 2 grade aluminum complex composed of a paraffinic oil with a viscosity of 64 SUS at 210° F. and 510 SUS at 100° F.

Base #3: No. 2 grade lithium complex composed of a paraffinic oil with a viscosity of 64 SUS at 210° F. and 510 SUS at 100° F.

Base #4: No. 1 grade calcium complex composed of both naphthenic and paraffinic oils with a viscosity of 60 SUS at 210° F. and 450 SUS at 100° F.

Base #5: No. 2 grade clay base composed of a paraffinic oil with a viscosity of 119 SUS at 210° F. and 2312 SUS at 100° F.

The results are tabulated in Tables I and II.

TABLE I

| COMPOSITION | 4-BALL EXTREME PRESSURE ASTM D-2596 WELD (kg) | 4-BALL EXTREME PRESSURE ASTM D-2596 LOAD WEAR INDEX | DROPPING POINT DEGREES FAHRENHEIT | 4-BALL Wear ASTM D-2266 WEAR (mm) | 4-BALL Wear ASTM D-2266 COEFFICIENT OF FRICTION | Timken ASTM D-2509 LOAD (LB.) |
|---|---|---|---|---|---|---|
| Base #1 | 160 | 44.003 | 379 | 0.859 | 0.072 | Failed @30 |
| 1.5% Dicalcium Phosphate 1.5% Polyphenylene Sulfide 97.0% Base #1 | 400 | 87.086 | 383 | 0.718 | 0.046 | OK + 50 |
| 2.5% Dicalcium Phosphate 2.5% Polyphenylene Sulfide 95.0% Base #1 | 400 | 91.889 | 363 | 0.666 | 0.035 | OK + 55 |
| 5.0% Dicalcium Phosphate 5.0% Polyphenylene Sulfide 90.0% Base #1 | 620 | 90.412 | 362 | 0.462 | 0.044 | OK + 60 |

TABLE II

| COMPOSITION | 4-BALL EXTREME PRESSURE ASTM D-2596 WELD (kg) | 4-BALL EXTREME PRESSURE ASTM D-2596 LOAD WEAR INDEX | DROPPING POINT DEGREES FAHRENHEIT | 4-BALL WEAR ASTM D-2266 WEAR (mm) | 4-BALL WEAR ASTM D-2266 COEFFICIENT OF FRICTION | TIMKEN ASTM D-2509 LOAD (LB.) |
|---|---|---|---|---|---|---|
| 3% Additive #1* 97.0% Base #1 | 315 | 72.369 | 365 | 0.662 | 0.044 | OK + 50 |
| 97.0% Base #2 3.0% Additive #1 | 250 | 82.732 | 523 | 0.724 | 0.049 | OK + 30 |
| 97.0% Base #3 3.0% Additive #1 | 315 | 78.079 | 460 | 0.949 | 0.046 | OK + 55 |
| 97.0% Base #4 3.0% Additive #1 | 315 | 86.266 | 554 | 0.468 | 0.043 | OK + 55 |
| 97.0% Base #5 3.0% Additive #1 | 200 | 87.118 | +600 | 0.639 | 0.055 | OK + 30 |

*Additive # comprised 90% dicalcium phosphate and 10% polyphenylene sulfide.

Utilizing the same grease bases, a number of compositions were prepared employing molybdenum disulfide as the additive, and compared under the same test conditions, with compositions prepared in accordance with the teachings of this invention. The test results are summarized in Table III.

TABLE III

| COMPOSITION | 4-BALL EXTREME PRESSURE ASTM D-2596 WELD (kg) | 4-BALL EXTREME PRESSURE ASTM D-2596 LOAD WEAR INDEX | DROPPING POINT DEGREES FAHRENHEIT | 4-BALL WEAR ASTM D-2266 WEAR (mm) | 4-BALL WEAR ASTM D-2266 COEFFICIENT OF FRICTION | TIMKEN ASTM D-2509 LOAD (LB.) |
|---|---|---|---|---|---|---|
| Base #1 | 160 | 44.003 | 379 | 0.859 | 0.072 | Failed @ 30 |
| 3.0% Molybdenum Disulfide T.F. | 250 | 65.15 | 378 | 0.726 | 0.062 | Failed @ 30 |

TABLE III-continued

| COMPOSITION | 4-BALL EXTREME PRESSURE ASTM D-2596 WELD (kg) | LOAD WEAR INDEX | DROPPING POINT DEGREES FAHRENHEIT | 4-BALL WEAR ASTM D-2266 WEAR (mm) | COEFFICIENT OF FRICTION | TIMKEN ASTM D-2509 LOAD (LB.) |
|---|---|---|---|---|---|---|
| 97.0% Base #1 Base #2 3.0% Moly T.F. | 126 | 33.131 | 523 | 0.641 | 0.105 | Failed @ 30 |
| 97.0% Base #2 Base #3 3.0% Moly T.F. | 315 | 72.926 | 512 | 0.756 | 0.035 | Failed @ 30 |
| 97.0% Based #3 Base #4 97.0% Base #4 3.0% Molybdenum Disulfide T.F. | 160 | 35.788 | 478 | 1.261 | 0.115 | Failed @ 30 |
| Base #5 97.0% Base #5 | 400 | 71.928 | 503 | 0.974 | 0.032 | Failed @ 30 |
| | 315 | 85.605 | 560 | 0.474 | 0.080 | OK = 50 |
| | 400 | 109.048 | 558 | 0.425 | 0.041 | OK = 55 |
| | 126 | 54.094 | +600 | 0.949 | 0.062 | Failed @ 30 |
| | 250 | 61.095 | +600 | N.A. | N.A. | Failed @ 30 |

Additional lubricant compositions were formulated using other metal salts, combinations of metal salts, and graphite as a supplemental component of the additive package. The test results are set forth in Table IV.

TABLE IV

| COMPOSITION | 4-BALL EXTREME PRESSURE ASTM D-2596 WELD (kg) | LOAD WEAR INDEX | DROPPING POINT DEGREES FAHRENHEIT | 4-BALL WEAR ASTM D-2266 WEAR (mm) | COEFFICIENT OF FRICTION | TIMKEN ASTM D-2509 LOAD (LB.) |
|---|---|---|---|---|---|---|
| 1.5% Disodium Phosphate 1.5% Polyphenylene Sulfide 97.0% Base #1 | 315 | 70.595 | 373 | 0.654 | 0.048 | OK = 40 |
| 1.5% Aluminum Phosphate 1.5% Polyphenylene Sulfide 97.0% Base #1 | 315 | 80.454 | 362 | 0.669 | 0.044 | OK = 40 |
| 1.5% Ferric Orthophosphate 1.5% Polyphenylene Sulfide 97.0% Base #1 | 315 | 63.772 | 379 | 0.436 | 0.0443 | OK = 35 |
| 2.0% Graphite #3124 2.0% Polyphenylene Sulfide 1.0% Dicalcium Phosphate 95.0% Base #1 | 500 | 97.66 | 378 | 0.694 | 0.053 | OK = 40 |
| 2.0% Graphite #3124 1.0% Polyphenylene Sulfide 2.0% Dicalcium Phosphate 95.0% Base #1 | 500 | 96.14 | 378 | 0.538 | 0.057 | OK = 40 |
| 1.0% Polyphenylene Sulfide 1.0% Dicalcium Phosphate 1.0% Calcium Carbonate 97.0% Base #1 | 315 | 69.18 | 383 | 0.547 | 0.055 | OK = 35 |
| 1.0% Polyphenylene Sulfide 1.0% Dicalcium Phosphate 1.0% Calcium Carbonate 1.0% Graphite #3124 96.0% Base #1 | 315 | 74.69 | 383 | 0.647 | 0.053 | OK = 35 |

What is claimed is:

1. A lubricant composition for use under extreme pressure conditions comprising a major proportion of a lubricating oil base grease and a minor proportion of an additive consisting essentially of a mixture of a solid, high melting point, oil insoluble arylene sulfide polymer and a metal salt selected from the group consisting of metal phosphates and metal carbonates, and mixtures thereof, said additive being present in an amount sufficient to impart extreme pressure properties to the lubricating grease.

2. A lubricant composition according to claim 1 wherein the metal salt is an alkali metal or alkaline earth metal phosphate or an alkali metal or alkaline earth metal carbonate, or a mixture thereof.

3. A lubricant composition according to claim 1 wherein the arylene sulfide polymer is polyphenylene sulfide.

4. A lubricant composition according to claim 2 wherein the metal salt is monocalcium phosphate or dicalcium phosphate.

5. A lubricant composition according to claim 2 wherein the alkaline earth metal carbonate is calcium carbonate.

6. A lubricant composition according to claim 1 wherein the mixture of the arylene sulfide polymer and the metal salt comprises from about 1% to about 10%, by weight, of the lubricant composition.

7. A lubricant composition according to claim 1 wherein the ratio of arylene sulfide polymer to metal salt is from about 1:9 to about 9:1.

8. A lubricant composition according to claim 1 wherein a minor proportion of graphite is added to the composition.

9. A lubricant composition according to claim 1 wherein the lubricating grease is selected from the group consisting of lithium base greases, aluminum complex base greases, calcium complex base greases, barium greases and clay base greases.

10. A lubricant composition according to claim 1 wherein a minor amount of an inorganic pigment is added to the composition.

11. A lubricant composition according to claim 2 wherein a mixture of metal salts comprising calcium carbonate and dicalcium phosphate is incorporated in the composition.

12. A lubricant composition according to claim 10 wherein the inorganic pigment comprises a mixture of ferric oxide, carbon black and titanium dioxide.

13. A lubricant composition according to claim 1 wherein the metal salt is aluminum phosphate, ferric orthophosphate or cadmium phosphate.

14. A lubricant composition according to claim 1 wherein the polymer is in the form of a powder, the average particle size of which is in the range of 50 to 150 mesh.

* * * * *